US005371906A

United States Patent [19]

Tzang

[11] Patent Number: 5,371,906

[45] Date of Patent: Dec. 13, 1994

[54] TOILET SEAT RING AUTOMATIC RAISING STRUCTURE USING MAGNETS

[76] Inventor: Tzong-Pay Tzang, No. 9-2, Lane 50, Sec. 2, Wu-Chang St., Taipei, Taiwan, Prov. of China

[21] Appl. No.: 110,895

[22] Filed: Aug. 24, 1993

[51] Int. Cl.[5] ..... A47K 13/10

[52] U.S. Cl. ..... 4/246.1; 4/246.3

[58] Field of Search ..... 4/237, 241, 246.1, 246.3, 4/246.4, 246.5, 248; 220/264, 263; 292/251.5

[56] References Cited

U.S. PATENT DOCUMENTS

| | | | |
|---|---|---|---|
| 2,888,290 | 5/1959 | Pierce | 292/251.5 |
| 3,184,803 | 5/1965 | Peel | 292/251.5 |
| 3,258,285 | 6/1966 | Smith | 292/251.5 |
| 4,426,743 | 1/1984 | Seabrooke | 4/246.3 |
| 4,561,130 | 12/1985 | Bumgardner et al. | 4/240 |
| 4,951,323 | 8/1990 | Shalom | 4/246.1 |
| 5,020,165 | 6/1991 | Huang | 4/246.2 |
| 5,150,483 | 9/1992 | Lochrie | 4/246.1 |

*Primary Examiner*—Henry J. Recla
*Assistant Examiner*—Charles R. Eloshway
*Attorney, Agent, or Firm*—Pro-Techtor International

[57] ABSTRACT

A toilet seat ring automatic raising structure consists of magnetic lever and magnetic spring types. The magnetic lever type of structure has a pair of actuating legs with appropriate weight for lifting up the seat ring automatically. The actuating legs have iron rods which are attracted to the magnetic rods in a magnetic base so that the seat ring can be securely held in place. The repelling and releasing of the magnetic force is used to lift up the seat ring automatically. The magnetic spring type of structure has magnetic rods installed on the inner edge of the seat ring, such magnetic rods have corresponding magnetic coils in a base. When the seat ring is covering up the toilet bowl, the magnetic rods are attracted to the magnetic coils so that the seat ring can be held securely in place. To lift up the seat ring, power is applied to the magnetic coils from which repelling magnetic forces are generated and the attraction between the magnetic rods and the magnetic coils are released. Therefore, the seat ring can be lifted up gradually by the resiliency of a spring.

2 Claims, 14 Drawing Sheets

TOILET SEAT RING AUTOMATIC RAISING STRUCTURE USING MAGNETS

BACKGROUND OF THE INVENTION (a) Field of the Invention

The present invention relates to a toilet seat automatic raising structure using magnets. More specifically, the present invention relates to a toilet seat ring raising structure which functions automatically either by use of a magnetic lever or a magnetic spring.

(b) Description of the Prior Art

Heretofore, there are many types of toilet seat automatic raising structures developed. However, the majority of these structures are not widely accepted by the general public. Therefore, manufacturers do not want to produce them in high quantities. This is because these toilet seat raising structures are fairly complicated and the manufacturing costs are relatively high. These automatic raising structures are considered unnecessary because of their high price, therefore. they are not generally accepted by the public consumer.

In addition to the drawback in high cost, the complex structure which commonly requires mechanical components such as gears and linkages are not user friendly. A user has to push the button for the device to operate. However, the user that is not familiar with the device may manually lift up the toilet seat directly. This could destroy the structure of the automatic raising device and possibly damage the toilet seat. This is inconvenient for the user.

Despite the drawbacks, the toilet seat automatic raising structure is still practical to be used in our daily lives. The majority of the user do not lift up the toilet seat ring after use, this is partly a habitual thing and partly because the users do not want to touch the unsanitary seat ring. Therefore, it would be nice to have a toilet seat ring automatic lifting device installed with the toilet tank.

SUMMARY OF THE INVENTION

The main object according to the present invention is to provide a magnetic type toilet seat ring automatic raising device which is of simple construction and practical to use. Such automatic raising device can either use a magnetic lever or a magnetic spring.

Another object according to the present invention is to provide a toilet seat ring automatic raising device such that the manufacturing cost of the device is effectively lower.

A further object according to the present invention is to provide a toilet seat ring automatic raising device so that the user can be accustomed to the lifting of the toilet seat ring for the convenience of others.

Still another object according to the present invention is to provide a toilet seat ring automatic raising device such that the cover can also be lifted up manually without causing any damage to the structure.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 2:
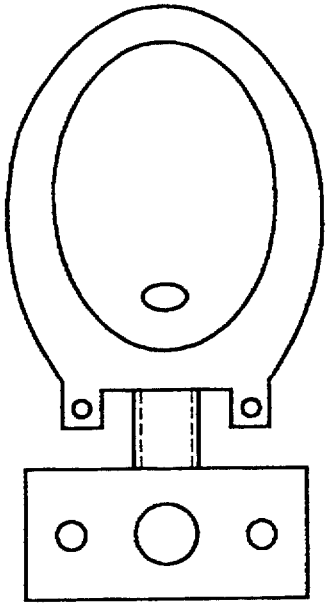
FIG. 2 is a top view of FIG. 1 before the installation of the actuating legs.
Figure 1:
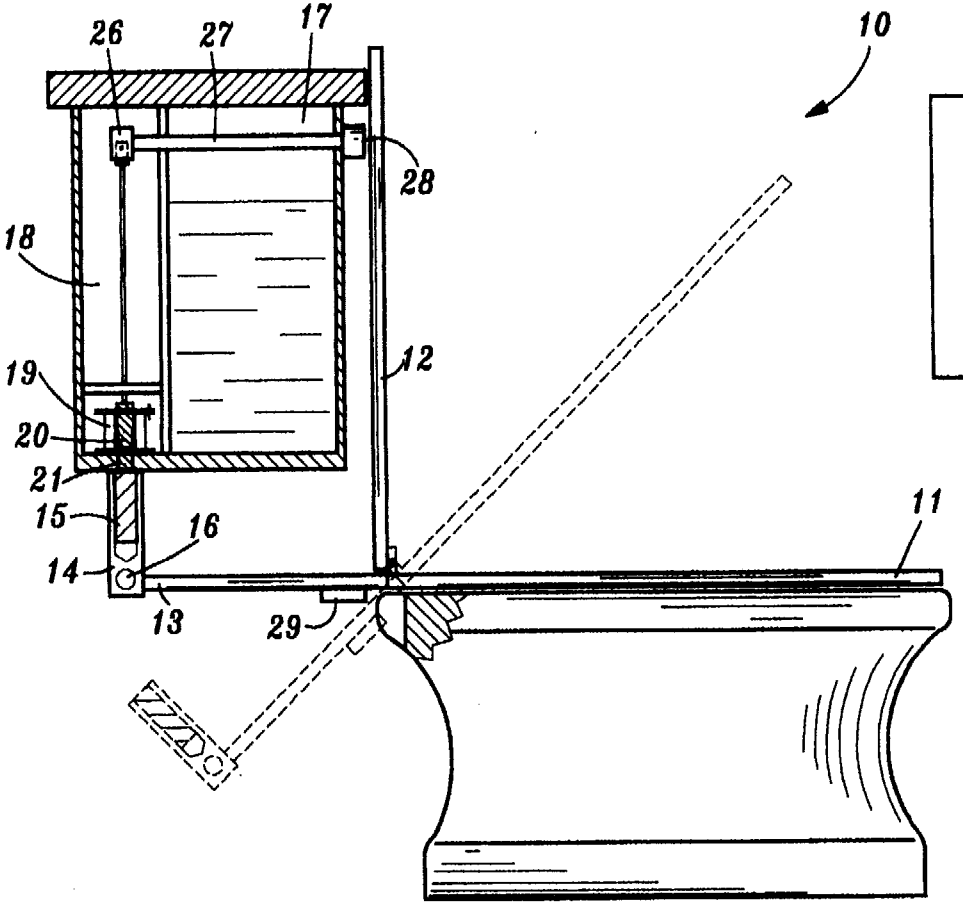
FIG. 1 is a vertical cross-sectional side view of the double-leg magnetic lever type automatic toilet seat ring raising structure according to the present invention.

Please refer to FIGS. 1 and 2 for vertical cross-sectional side view and top view of the double-leg magnetic lever type automatic toilet seat ring raising structure according to the present invention. The seat of a toilet tank 10 includes a seat ring 11 and a cover 12, under which is a pair of seat ring actuating leg 13 extended thereof. The end of the actuating legs 13 has a weight matching device 14, which has an iron rod 15 and a specific gravity adjustment hole 16 installed and constructed therein. Behind the water tank 17 of the toilet tank 10 is a magnetic base holding slot 18, the bottom of which has a magnetic base 19 placed thereof. A magnetic rod 20 is installed inside the magnetic base 19 such that the magnetic rod 20 is axially aligned with the iron rod 15. In between the magnetic base 19 and the weight matching device 14 is a guided magnet 21, which facilitates the magnetic rod 20 attracting to the iron rod 15 of the weight matching device. As a consequence, the seat ring 11 is held down in place despite the weight of the weight matching device 14.

Figure 3:
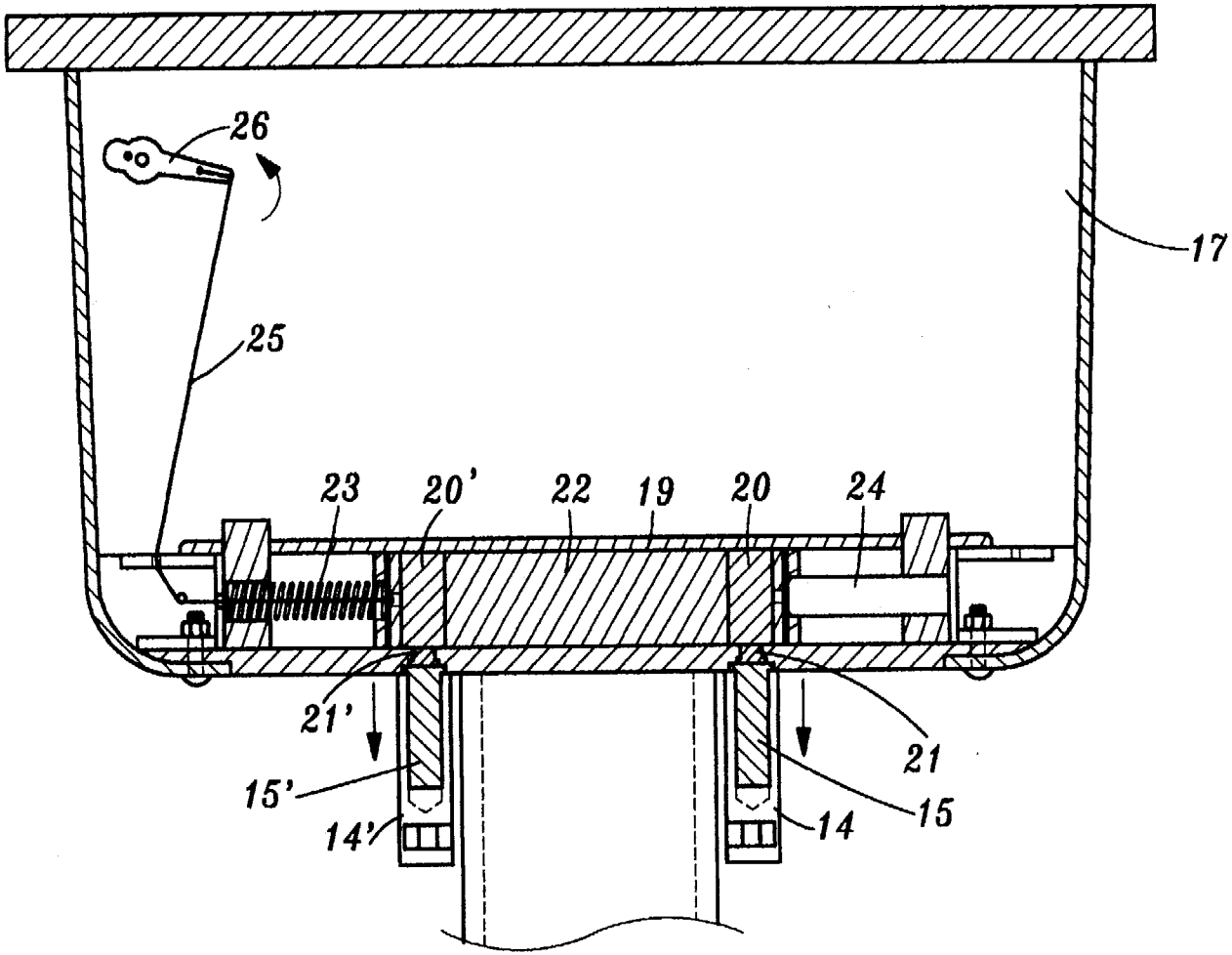
FIG. 3 is a cross-sectional view looking from the back of the structure of FIG. 1. This view shows the embodiment before the seat ring is lifted up from the structure using the mechanical disengagement of the magnetic force.

Please also refer to FIG. 3. The magnetic base 19 behind the water tank 17 has a magnetic force displacement device 22 contained therein. The magnetic force displacement device 22 is located in between the magnetic rods 20 and 20', its forward end is confined by a return spring 23 and its rearward end is pushing against a positioning rod 24. The forward end of the magnetic force displacement device 22 is connected to a lifting wire 25, which has an actuating switch handle 26 connected thereto. The actuating switch handle 26 is connected to an actuating handle 28 at the front of the water tank 17 through an actuating shaft 27, as shown in FIG. 1. The ends of the actuating leg 13 have two weight matching devices 14 and 14', which respectively have iron rods 15 and 15' contained therein. The iron rods 15 and 15' are then attracted by the magnetic rods 20 and 20' respectively. The use of the guided magnets 21 and 21' is to center the magnetic force and prevent the magnetic rod 20 and 20' from damage.

Figure 4:
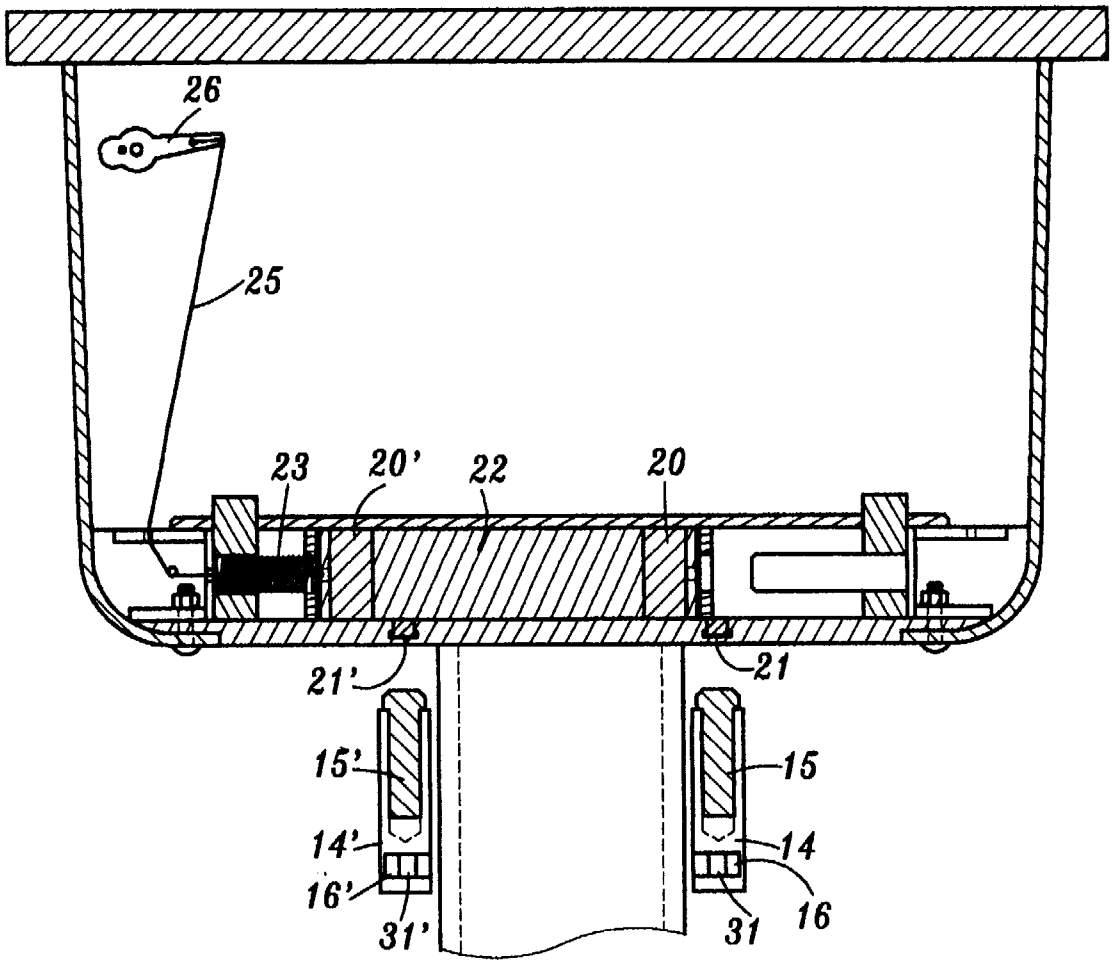
FIG. 4 is a cross-sectional view looking from the back of the structure of FIG. 1. This view shows the embodiment of the operation after the seat ring is lifted up by the structure using the disengagement of the magnetic force.

Referring to FIG. 4, the actuating handle 28 is pushed down, enabling the actuating switch handle 26 to be pushed upward. The lifting wire 25 then pulls the magnetic force displacement device 22 to the left side and compresses against the return spring 23 tightly. At this time, the two magnetic rods 20 and 20' contained within the magnetic force displacement device 22 move along with the latter towards the left side to disengage from the guided magnets 21. Hence, the iron rods 15 and 15' are no longer attracted by the magnetic rods 20 and 20'. The weight of the weight matching device 14 and 14' cause the seat ring actuating leg 13 to drop down due to the Earth's gravity. Referring to FIG. 1, the seat ring 11 is lifted up as a result of this. When the push handle 28 is released, the magnetic force displacement device 22 returns to its original position due to the tension of the return spring 23. The seat ring actuating legs 13 have resilient pads 29 which are located in the periphery underneath the cover 12. After the seat ring 11 is lifted upward, the two seat ring actuating legs 13 are positioned behind the toilet seat, the seat ring 11 is also positioned behind the toilet seat. The lowering of the weight to matching device 14 causes the cover and the seat ring 12 collide and generate some noise. In order to avoid the repeat collision and cause possible damage, the resilient pads 29 are used to slow down the collision. In addition, the weight matching device 14 and 14' have specific gravity holes 16 and 16' which have fine adjustment specific gravity blocks 31 and 31' placed thereof. The purpose of the fine adjustment specific gravity blocks 31 and 31' is the smooth operation of the lifting of the seat ring. The addition of the dead weight is used for adjusting the front portion and the back portion to have an appropriate weight ratio.

Figure 5:
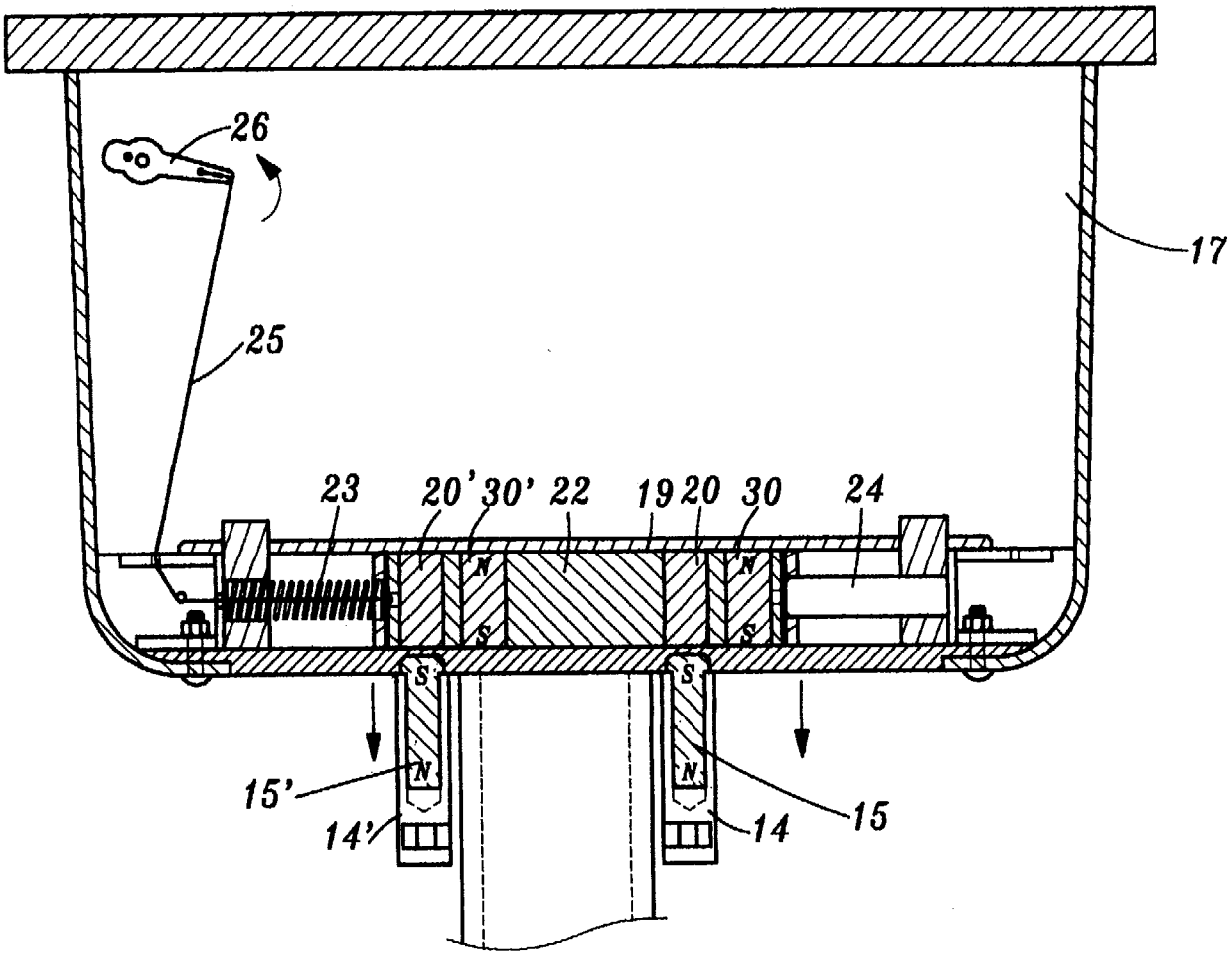
FIG. 5 is a cross-sectional view looking from the back of the structure of FIG. 1. This view shows the embodiment before the seat ring is lifted up from the structure using the mechanical repelling of the magnetic force.
Figure 6:
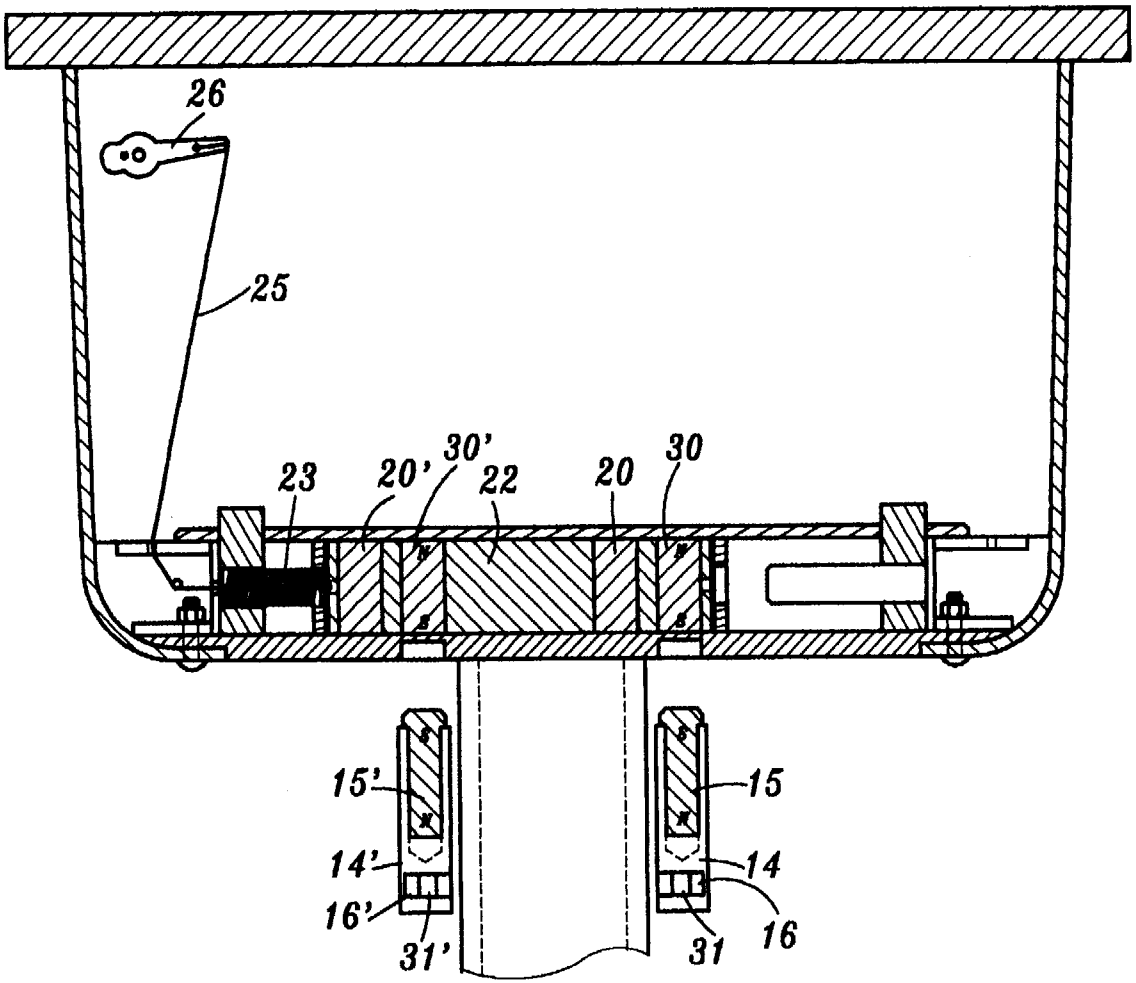
FIG. 6 is a cross-sectional view looking from the back of the structure of FIG. 1. This view shows the embodiment of the operation after the seat ring is lifted up by the structure using the repelling of the magnetic force.

Referring to FIGS. 5 and 6, the magnetic force displacement device 22 has a pair of iron rods 20 and 20' contained therein. The two weight matching blocks 14 and 14' have two magnetic rods 15 and 15' placed therein. When the magnetic rods 15 and 15' are attracting the iron rods 20 and 20', the seat ring 11 is held in place in a seating position as shown in FIG. 1. The magnetic rods 15 and 15' have their south poles at the top and their north poles at the bottom. Located to the right hand side of the iron rods 20 and 20' are magnetic rods 30 and 30' with their south poles on the bottom and their north poles at the top. When the actuating handle 28 is pushed down, the actuating switch handle causes the lifting wire 25 to pull up, thus the magnetic force displacement device 22 is pushed to the left hand side, as shown in FIG. 6. As a consequence, the south poles of the magnetic rods 30 and 30' are facing the south poles of the magnetic rods 15 and 15', therefore, they repel to each other. This repelling speeds up the dropping of the weight matching blocks 14 and 14'. By such structure, the fine adjustment specific gravity blocks 31 and 31' can be eliminated from the configuration. In addition, the iron rods 20 and 20' can be substituted by magnetic rods, which are placed in a position to attract the magnetic rods 15 and 15'.

Figure 7:
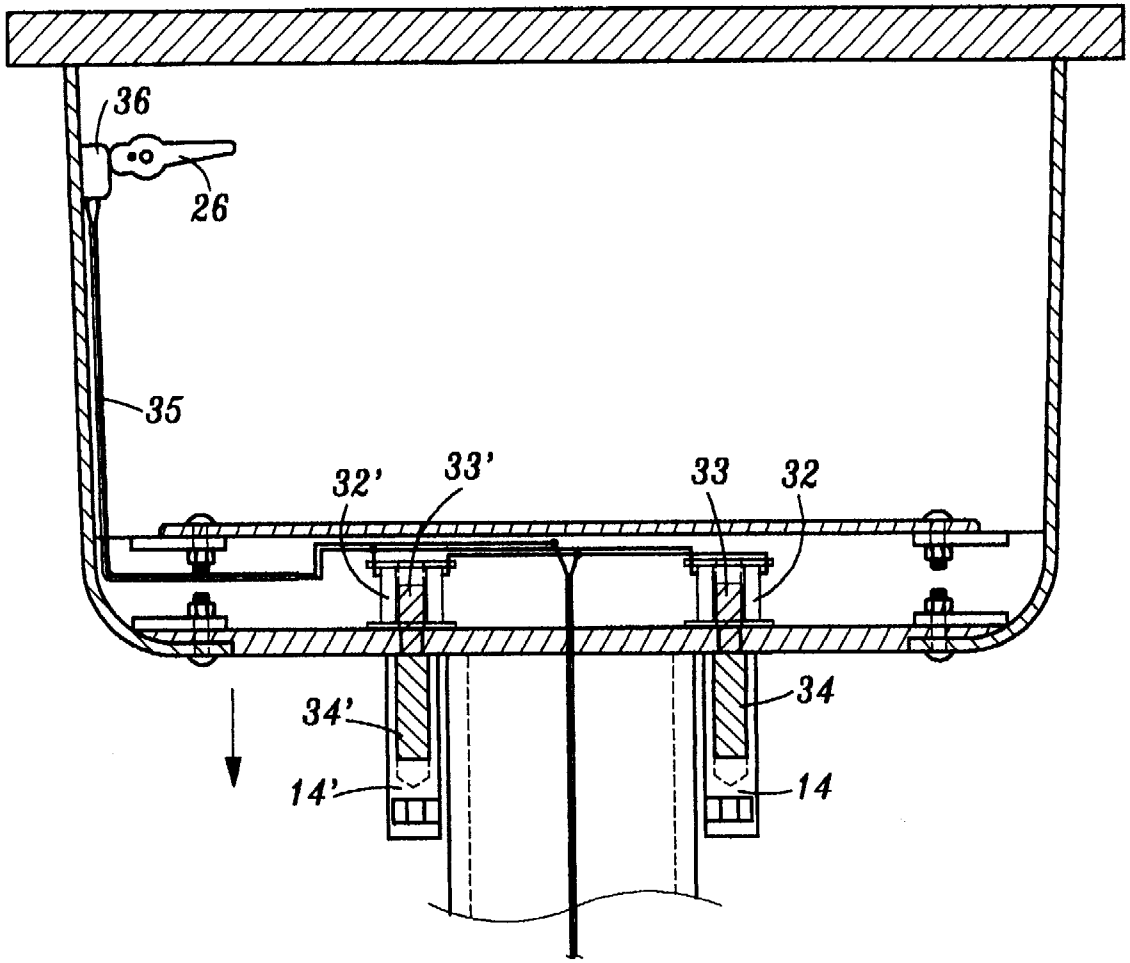
FIG. 7 is a cross-sectional view looking from the back of the structure of FIG. 1. This view shows the embodiment before the seat ring is lifted up from the structure using the disengagement of the electromagnetic force.
Figure 8:
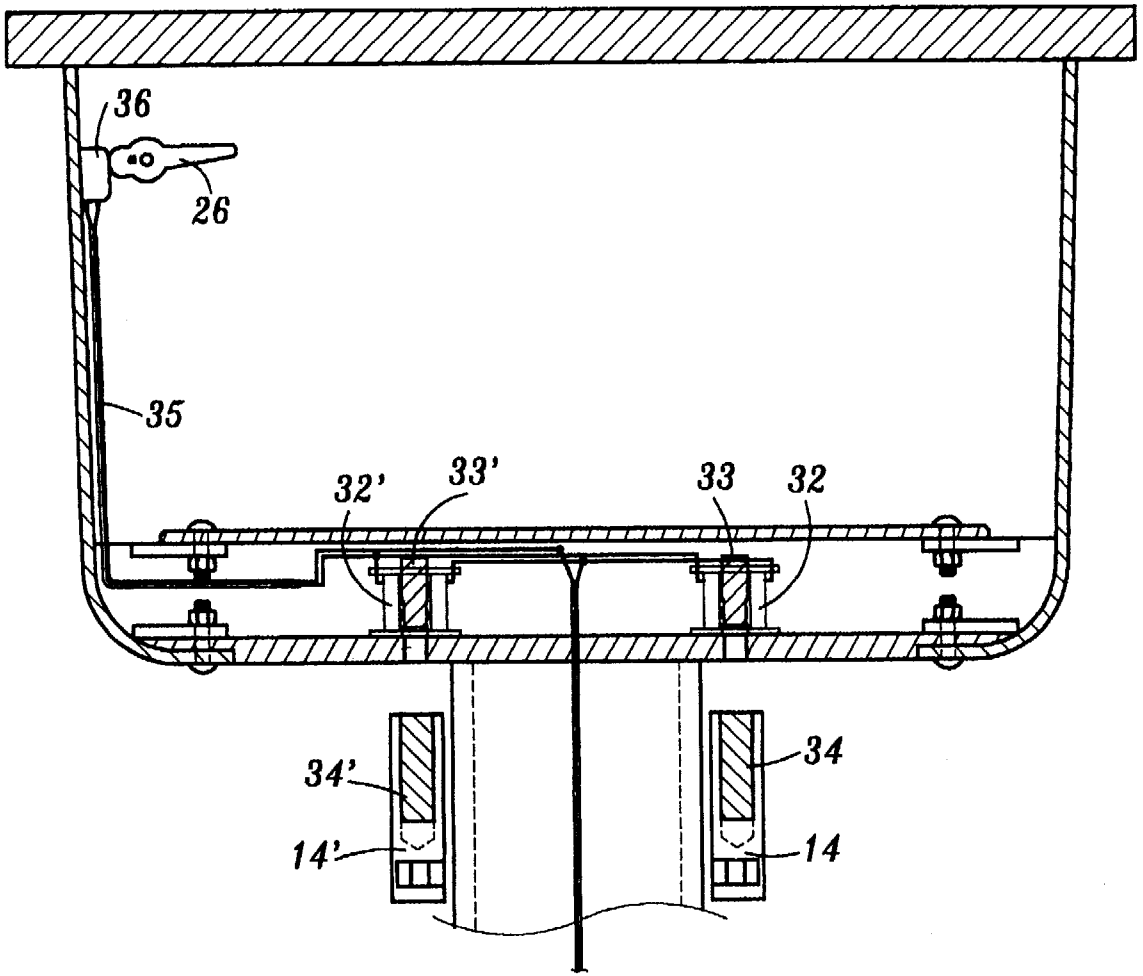
FIG. 8 is a cross-sectional view looking from the back of the structure of FIG. 1. This view shows the embodiment of the operation after the seat ring is lifted up by the structure using the disengagement of the electromagnetic force.

Referring to FIG. 7, the weight matching devices 14 and 14' of the electromagnetic device have magnetic rods 34 and 34' contained therein. On top of the weight matching devices 14 and 14' are two magnetic coils 32 and 32' which attract the iron core 33 and 33' so that the weight matching devices 14 and 14' are secured. The two magnetic coils 32 and 32' are connected to a micro switch 36 through a wire 35. Referring to FIG. 8, when the actuating handle 28 is pushed down, the actuating switch handle 26 moves up to trigger the micro switch 36, thus the two magnetic coils 32 and 32' generates a magnetic field in which the magnetic force pulls the iron core 33 and 33' upward to a balanced position. At this time the iron cores 33 and 33' are disengaged from the magnetic rods 34 and 34', the weight matching blocks 14 and 14' therefore drop down, permitting the toilet seat ring 11 lift up, as shown in FIG. 1.

Figure 9:
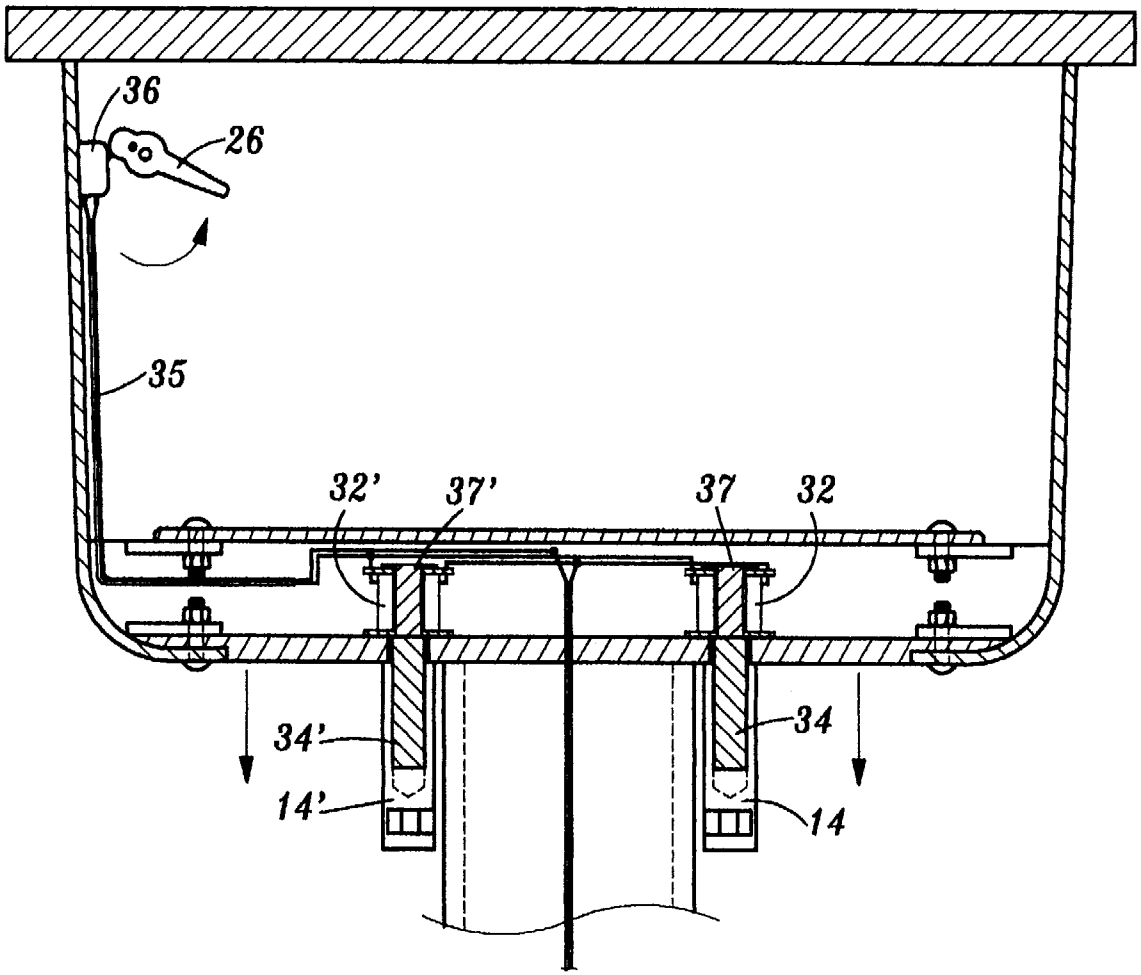
FIG. 9 is a cross-sectional view looking from the back of the structure of FIG. 1. This view shows the embodiment before the seat ring is lifted up from the structure using the repelling of the electromagnetic force.
Figure 10:
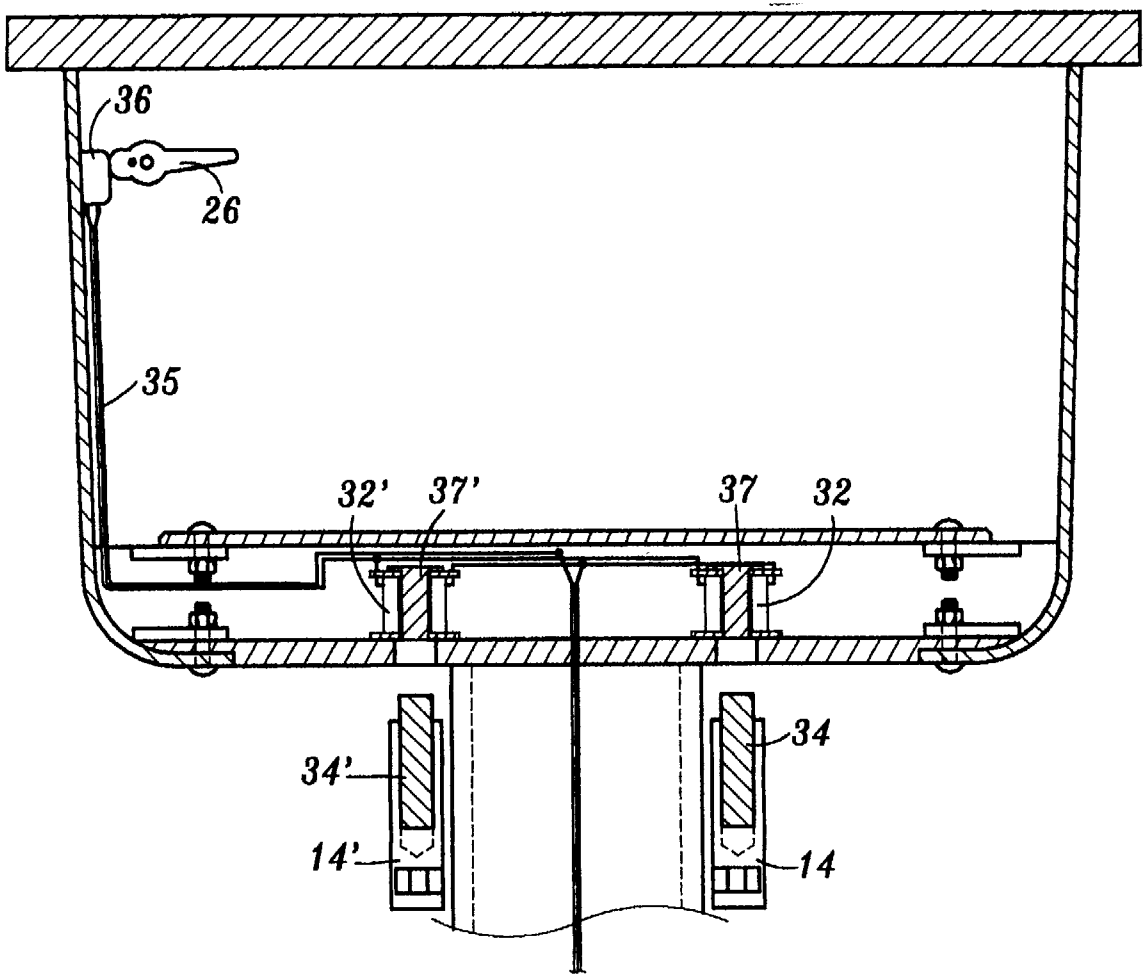
FIG. 10 is a cross-sectional view looking from the back of the structure of FIG. 1. This view shows the embodiment of the operation after the seat ring is lifted up by the structure using the repelling of the electromagnetic force.

Please refer to FIGS. 9 and 10 which shows a cross-sectional view looking from the back of the structure of FIG. 1. This view shows the embodiment of the structure using the repelling of the electromagnetic force. In a similar manner, the weight matching devices 14 and 14' of the electromagnetic device has magnetic rods 34 and 34' contained therein. The center of the two magnetic coils 32 and 32' on the top of the weight matching devices have iron cores 37 and 37' which are of circular T-shapes. The circular T-shaped perimeters of the iron cores 37 and 37' permit them to be retained in the top center of the magnetic coils 32 and 32'. When the actuating handle 28 is pushed down, the actuating switch handle moves upward and triggers the micro switch 36. Through the conduction of the wire 35, the two magnetic coils 32 and 32' generates a magnetic field. The iron cores 37 and 37' have been placed at the center of the magnetic coils 32 and 32' and are considered to be in a balanced state at this time. When electric current is applied to the magnetic coils 32 and 32', they generate magnetic fields to magnetize the iron cores 37 and 37'. As a consequence, the iron cores 37 and 37' produce a force that repels the magnetic rod 34 and 34', causing the iron cores 37 and 37' to be disengaged from the magnetic rods 34 and 34' again. Thus the weight matching devices 14 and 14' drop down and the toilet seat ring 11 moves up, as is shown in FIG. 1. Also, the micro switch 36 used can be replaced by a regular push button switch and be installed in an appropriate and convenient location on the wall.

Figure 11:
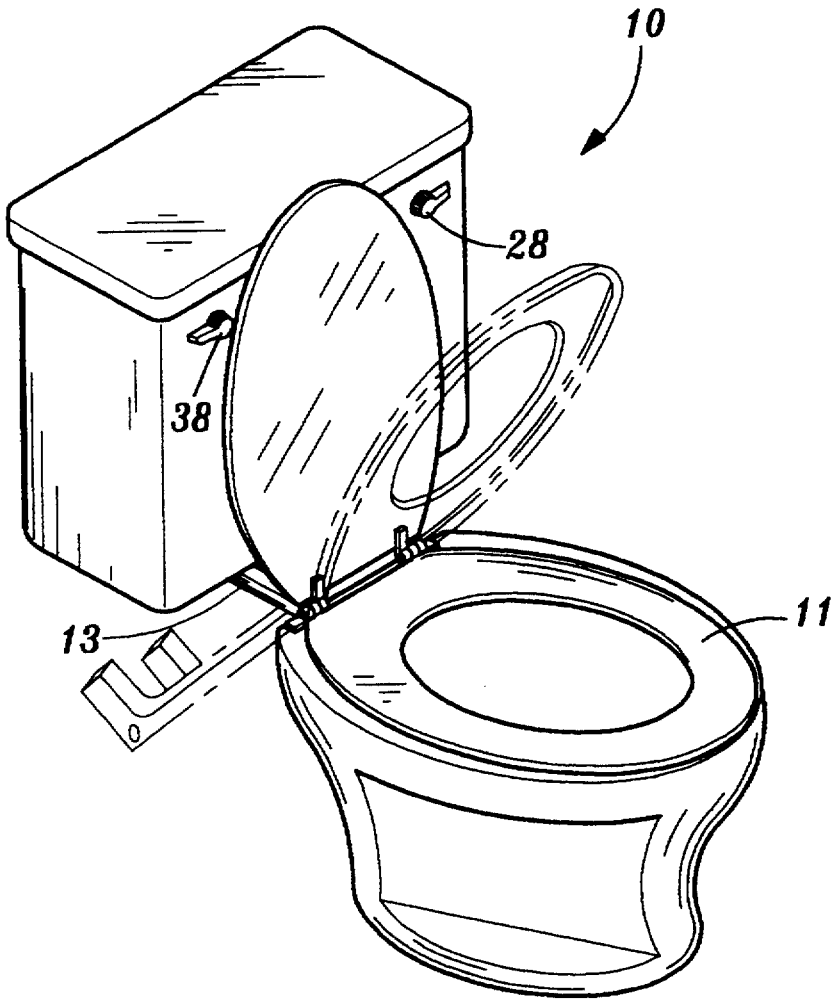
FIG. 11 is a perspective diagrammatic view of the automatic seat ring lifting structure according to the present invention.

Please refer to FIG. 11 for a perspective diagrammatic view of the double-leg magnetic lever type automatic seat ring raising device according to the present invention. When the actuating handle 28 is pushed down, the actuating legs 13 extending from the seat ring 11 drop down slowly due to the weight of the weight matching device. Accordingly, the toilet seat ring 11 is raised upward. When a user wants to lower the seat ring 11 for use, he pushes the seat ring downward gently. The attraction of the magnets can secure the seat ring 11 in place. The function of the weight matching device to is to prevent the seat ring from hitting the bowl of the toilet tank rapidly and cause damage thereof.

For practical usage, the actuating handle 28 can be combined with the flush handle 38 of the toilet tank so than there is only one handle to operate the toilet tank. After using the toilet tank, the user can flush the bowl and raise up the seat ring with a single step.

Figure 12:
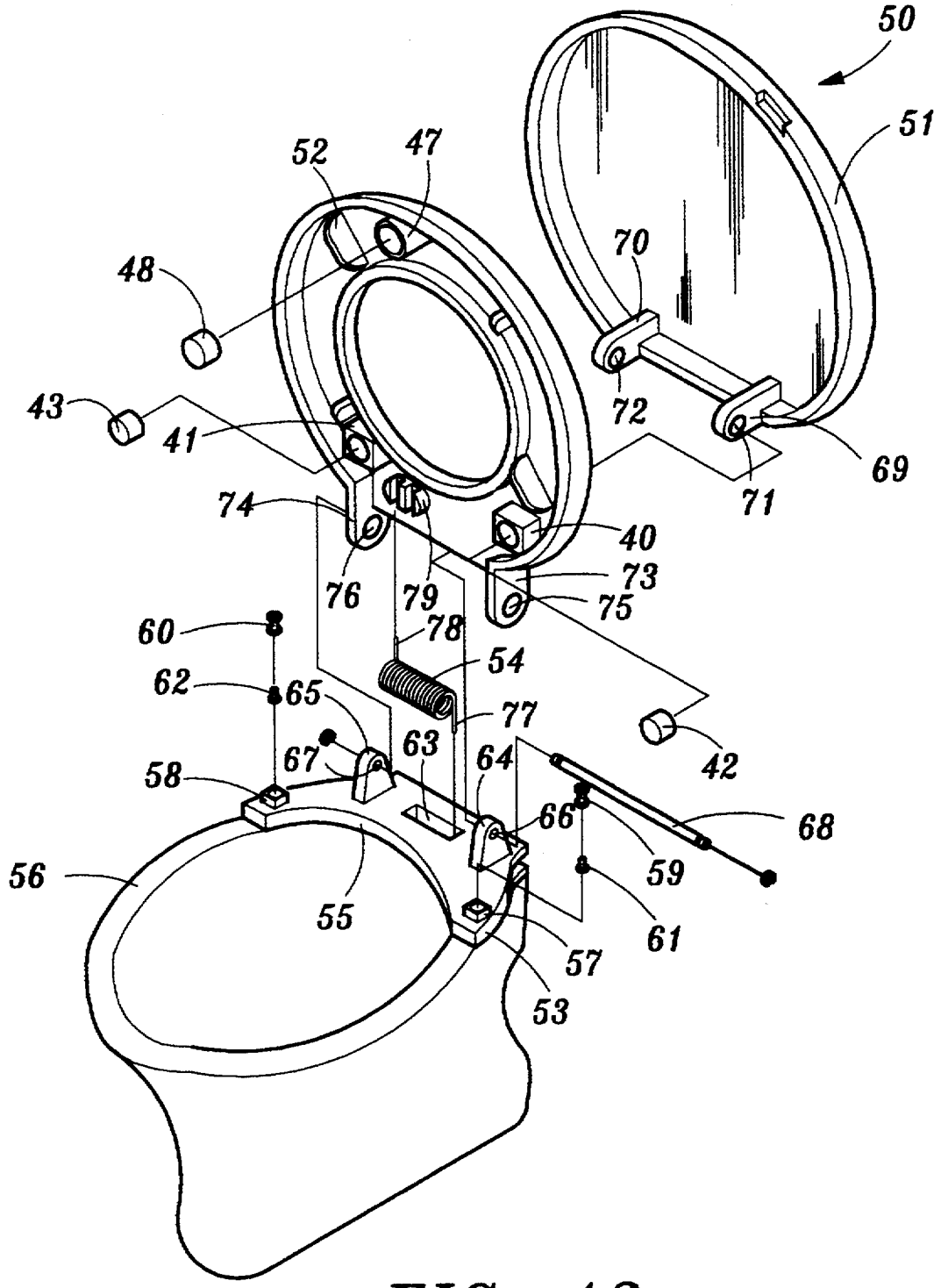
FIG. 12 is a perspective fragmented view of the magnetic spring type structure for lifting the seat ring automatically according to the present invention.

Please refer to FIG. 12 for a perspective fragmented view of the magnetic spring type seat ring automatic raising device 50 according to the present invention. The automatic raising device 50 mainly consists of a top cover 51, a toilet seat ring 52, a base 53 and a spring 54. The base 53 has an arc portion 55 with electromagnetic coil openings 57 and 58 at each end for placing of electromagnetic coils 59 and 60 by gluing. The internal central portions of the two magnetic coils 59 and 60 have reverse-T-shaped circular iron cores 61 and 62. The base 53 also have an elongated square hole 63, each side of which has a lug 64 or 65. Each of the two lugs has a feed through hole 66 or 67. The top cover 51 also have two lugs 69 and 70, each of which also has a feed through hole 71 or 72. The bottom part of the toilet seat ring 52 also has two lugs 73 and 74, each of which has a feed through hole 75 or 76. Two bolts 68 are used in each side to feed through the holes 64 and 65 of the base, the holes 71 and 72 of the top cover 51, through and including the holes 75 and 76 of the toilet seat ring 52, so as to hinge the top cover 51 and the seat ring 52 together. The spring 52 is inserted in the bolt 68 and feed through the aforesaid holes in such a manner that the top cover 51 and the seat ring 52 can be raised up or cover down. The right supporting leg 77 of the spring is supported inside the elongated hole 63 and the left supporting leg 78 is situated on a supporting pad 79 of the seat ring 52, this makes the movement of the seat ring 52 restricted by the resiliency of the spring 54, thus the seat ring will not fall down easily. The seat ring 52 has a pair of magnetic block holes 40 and 41 which are used for holding two magnetic blocks 42 and 43 in there through glue-on. By such configuration, when the seat ring 52 is covering the toilet bowl 56, the two magnetic blocks 42 and 43 are attracted to the iron cores 61 and 62 of the electromagnetic coils 59 and 60. This magnetic attraction, together with the resiliency of the spring 54, enable the seat ring to be securely held in place. In addition, the upper portion of the inner edge of the seat ring 52 has an adjustment hole 47 in which a weight matching block 48 is placed for fine adjustment of the weight of the seat ring 52.

Figure 13:
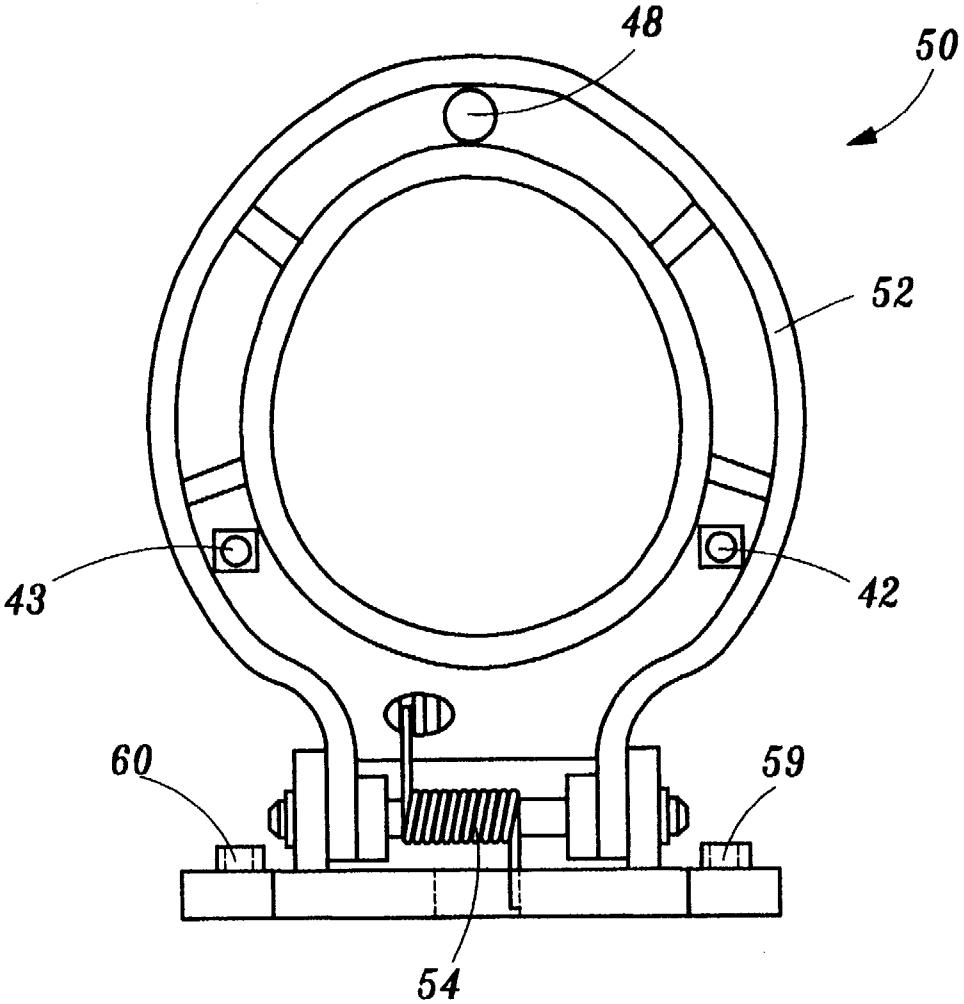
FIG. 13 is a front view of FIG. 12.

Please refer to FIG. 13 for a front view of the invention as shown in FIG. 12. The seat ring 52 is restricted by the resiliency of the spring 54. When the seat ring 52 is placed down, the resiliency of the spring cause it to bounce back. Therefore, the seat ring 52 is held down securely by having the magnetic blocks 42 and 43 attracted to the iron cores 61 and 62 of the magnetic coils 59 and 60, as is shown in FIG. 12. The fine adjustment on the weight matching block 48 is used to adjust the resiliency of the spring 54 to be slightly less than the magnetic attraction force and the weight of the seat ring 52. This assures that the seat ring 52 is held in place and its lifting operation is smooth.

Figure 14:
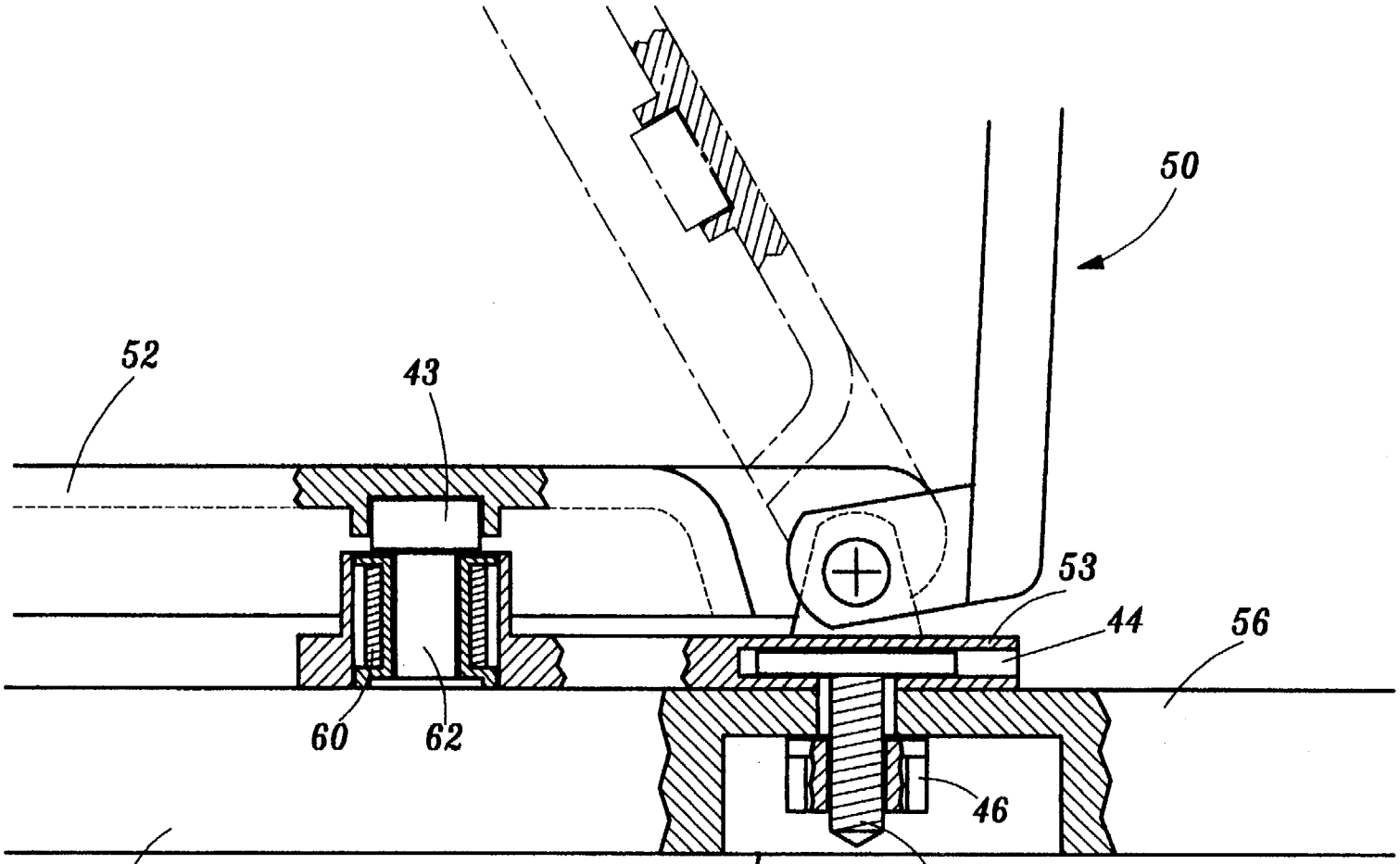
FIG. 14 is a sectional side view of the seat ring covering the toilet bowl of the magnetic spring type structure according to the present invention.

Please refer to FIG. 14 for a sectional side view of the seat ring 52 covering the toilet bowl 56 of the present invention as shown in FIG. 12. The seat ring automatic raising structure 50 is secured in the toilet bowl by its base 53. The base 53 has two pivotal holes 44 in which screw bolts 45 can be placed inside, two nuts 46 are used from the bottom of the toilet bowl 56 so that the seat ring 52 can be secured. When the seat ring 52 is covering the toilet bowl 56, the motion of the seat ring 52 is restricted by the spring 54. Therefore, the magnetic block 43 is used to attract to the iron core 62 of the magnetic coil 60. This attraction force, together with the weight of the seat ring 52, are slightly higher than the resiliency of the spring, hence the seat ring 52 will not be lifted up. The magnetic block 43 that attracts to the iron core 62 of the magnetic coil 60 form an electromagnetic device which requires two sets for the present invention.

Figure 15:
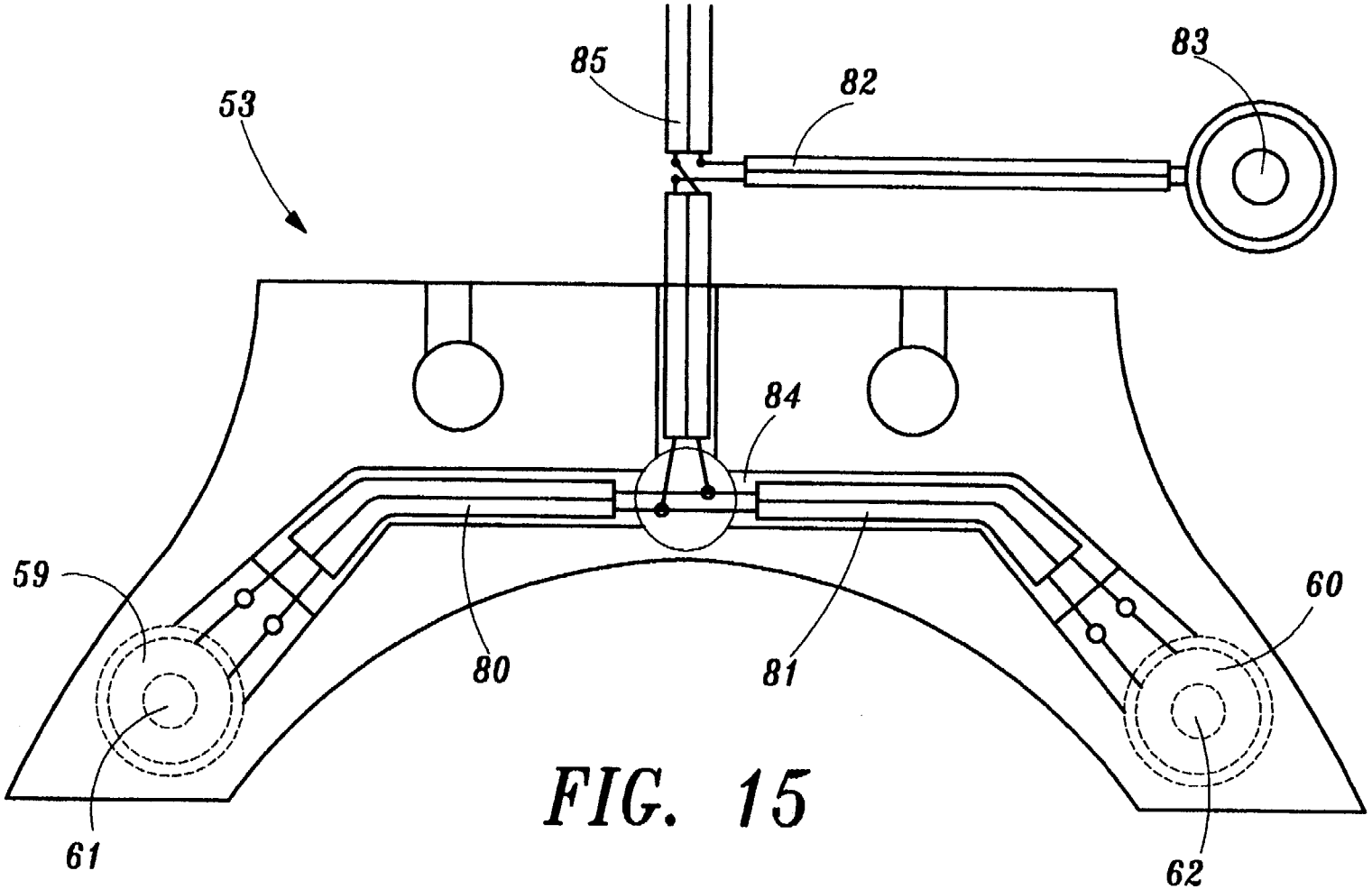
FIG. 15 is a bottom view of the base of the structure in FIG. 12.

Please refer to FIG. 15 for a bottom view of the base 53 as shown in FIG. 12. The electromagnetic coils 59 and 60 are connected to power wiring 80 and 81 which are buried inside the slot 84 on the bottom of the base 53. The power wiring 80 and 81 are pulled out to the external part behind the base 53, they are then connected together to form power wiring 82 and 85. The power wiring 82 is terminated at a push button switch 83 and the power wiring 85 is connected to the power source. When the push button switch 83 is turned on, current flows through the electromagnetic coils 59 and 60 which generate a magnetic field. The iron cores 61 and 62 of the electromagnetic coils 59 and 60 then repel to the magnetic blocks 42 and 43 of the seat ring 52, as is shown in FIG. 14. Therefore, when the push button switch 83 is turned on, the magnetic blocks 42 and 43 are repelling to the iron cores 61 and 62. As a consequence, the seat ring 52 is raised up by the resiliency of the spring 54, as is shown in FIG. 13. This accomplishes the function of lifting up the seat ring automatically in accordance with the present invention.

Although detailed embodiments of the invention are illustrated in the drawings and described in detail, this invention contemplates any configuration, design and relationship of components which will function in a similar manner and which will provide the equivalent result.

What is claimed is:

1. A toilet seat ring automatic raising apparatus which uses magnets comprising:

a toilet seat ring, adapted to be mounted on a toilet bowl, having a pair of actuating legs extending rearwardly therefrom, said legs further comprising a pair of weight matching devices operable to counterbalance the weight of the seat ring and thereby rotate the seat ring from a horizontal use position to a vertical non-use position, said weight matching devices each including an iron rod;

a magnetic base holding slot adapted to be mounted to a rear surface of an associated toilet flushing tank, said holding slot having a magnetic base located therein;

said magnetic base comprising a magnetic force displacement device, said displacement device including two magnetic rods which correspond in alignment respectively to the iron rods located in said weight matching devices when said seat ring is in said horizontal position;

a displacement actuation mechanism, connected to said force displacement device, and operable to move said magnetic rods out of alignment with said iron rods, thereby interrupting magnetic engagement between said magnetic rods and said iron rods;

guide magnets, positioned exteriorly of said magnetic rods and in alignment with said iron rods when said seat ring is in said horizontal position, for guiding said rods into magnetic engagement with said magnetic rods; whereby, said seat ring is held in said horizontal position by magnetic attraction between said iron rods and said magnetic rods, and is pivotable to said vertical position by means of said weight matching devices when said displacement mechanism is actuated to interrupt magnetic engagement between said iron rods and said magnetic rods.

2. A toilet seat ring raising apparatus according to claim 1 wherein each weight matching device includes a weight adjustment hole for fine adjustment of the weight of said weight matching device.

* * * * *